US005618165A

United States Patent [19]

Larsson et al.

[11] Patent Number: 5,618,165

[45] Date of Patent: Apr. 8, 1997

[54] VARIABLE DISPLACEMENT AND CONSTANT PRESSURE PUMP

[75] Inventors: Erik Larsson, Olofstorp; Gert Albertsson, Gothenburg, both of Sweden

[73] Assignee: AB Volvo, Sweden

[21] Appl. No.: 318,764

[22] PCT Filed: Apr. 14, 1993

[86] PCT No.: PCT/SE93/00323

§ 371 Date: Dec. 27, 1994

§ 102(e) Date: Dec. 27, 1994

[87] PCT Pub. No.: WO93/21424

PCT Pub. Date: Oct. 28, 1993

[30] Foreign Application Priority Data

Apr. 14, 1992 [SE] Sweden ..... 9201206

[51] Int. Cl.[6] ..... F04B 49/00

[52] U.S. Cl. ..... 417/220; 418/31; 418/24

[58] Field of Search ..... 417/270, 220; 418/31, 24, 25, 26, 27

[56] References Cited

U.S. PATENT DOCUMENTS

| | | | |
|---|---|---|---|
| 2,612,114 | 9/1952 | Ernst | 418/27 |
| 2,755,740 | 7/1956 | McKean | 417/220 |
| 2,799,995 | 7/1957 | Herman | 417/220 |
| 3,015,212 | 1/1962 | Krafft et al. | 418/26 |
| 3,060,858 | 10/1962 | Shoosmith | 417/220 |
| 3,238,884 | 3/1966 | Wright | 417/220 |
| 3,506,380 | 4/1970 | Powell | 417/220 |
| 3,663,130 | 5/1972 | Lincks | 418/31 |
| 3,724,972 | 4/1973 | Guetersloh | 417/220 |
| 3,771,921 | 11/1973 | Rohde | 418/31 |
| 3,850,548 | 11/1974 | DeLancey | 418/31 |
| 3,924,970 | 12/1975 | Johnston et al. | 417/212 |

FOREIGN PATENT DOCUMENTS

| | | | |
|---|---|---|---|
| 3436180 | 4/1986 | Germany . | |
| 3934280 | 4/1990 | Germany . | |
| 60-75780 | 4/1985 | Japan | 417/220 |
| 462761 | 8/1990 | Sweden . | |

*Primary Examiner*—Timothy Thorpe
*Assistant Examiner*—Peter G. Korytnyk
*Attorney, Agent, or Firm*—Lerner, David, Littenberg, Krumholz & Mentlik

[57] ABSTRACT

A pump comprising a pump housing (12) and a rotor (28) driven by a shaft (10), said rotor having at least two outwardly spring-biased elements (30). These lie in contact with the wall of a chamber (27) surrounding the rotor and transport, during rotation of the rotor, a gas and fluid medium from a suction port (15) to a pressure port (16) in the housing. The chamber (27) is arranged in a sliding block (18) which is displaceable inside the housing (12) in such a way that the chamber is movable between two end positions, of which one end position is concentric with, or presents a comparatively small eccentricity with respect to, the rotating shaft (10) of the rotor and which second end position presents a comparatively large eccentricity with respect to said shaft. The pump is moreover provided with means for positioning of the sliding block (18) in the pump housing

4 Claims, 4 Drawing Sheets

VARIABLE DISPLACEMENT AND CONSTANT PRESSURE PUMP

FIELD OF THE INVENTION

The present invention relates to a pump comprising a pump housing and a shaft-driven rotor having at least two outwardly spring-biased elements which lie in contact with the wall of a chamber surrounding the rotor and which, during rotation of the rotor, transport a gas and fluid medium from a suction port to a pressure port in the pump housing.

BACKGROUND TO THE INVENTION

Pumps according to the above are used for example for producing lubrication oil pressure in combustion engines for vehicles. The oil is transported by pressure to various parts of the engine and is used for lubricating a large number of bearings and hydraulic engine components.

It is normally required of an oil pump that it should give the required pressure even at the idling speed of the engine. Thus at higher speeds an unnecessarily high oil pressure is produced, which has to be reduced in some way, e.g. via an overflow valve.

The pump is normally driven by a power take-off from the engine drive shaft and the overproduction of oil pressure therefore has an effect on both the fuel consumption and the usable power. A variable displacement pump should be able to reduce the power requirement especially at speeds above idling. Such pumps are known but present disadvantages since they are comparatively expensive and complicated.

OBJECT OF THE INVENTION

The main object of the invention is therefore to achieve a pump which can deliver direct flow with constant pressure at varying speeds and which pump does not present the above mentioned disadvantages.

SUMMARY OF THE INVENTION

In order to achieve this object the invention is characterized in that the chamber surrounding the rotor is arranged in a body which is displaceable inside the pump housing in such a way that the chamber is movable between two end positions, of which one end position presents a comparatively small eccentricity with respect to, the rotating shaft of the rotor and the other end position presents a comparatively large eccentricity with respect to said shaft and in that the pump is provided with means for positioning of the body in the pump housing. The relatively small eccentricity in the one end position may be a small non-zero value or may be zero, in which case the housing in concentric with the shaft. Due to the design of the pump according to the invention, it can be used either in order to give the correct flow with constant back pressure at varying speed, or to give a varying flow at a constant speed.

Preferred embodiments of the invention are defined in the dependent claims.

BRIEF DESCRIPTION OF THE DRAWINGS

An embodiment of the invention will now be described in more detail with reference to the accompanying drawings, in which.

DESCRIPTION OF PREFERRED EMBODIMENTS

Figure 1:
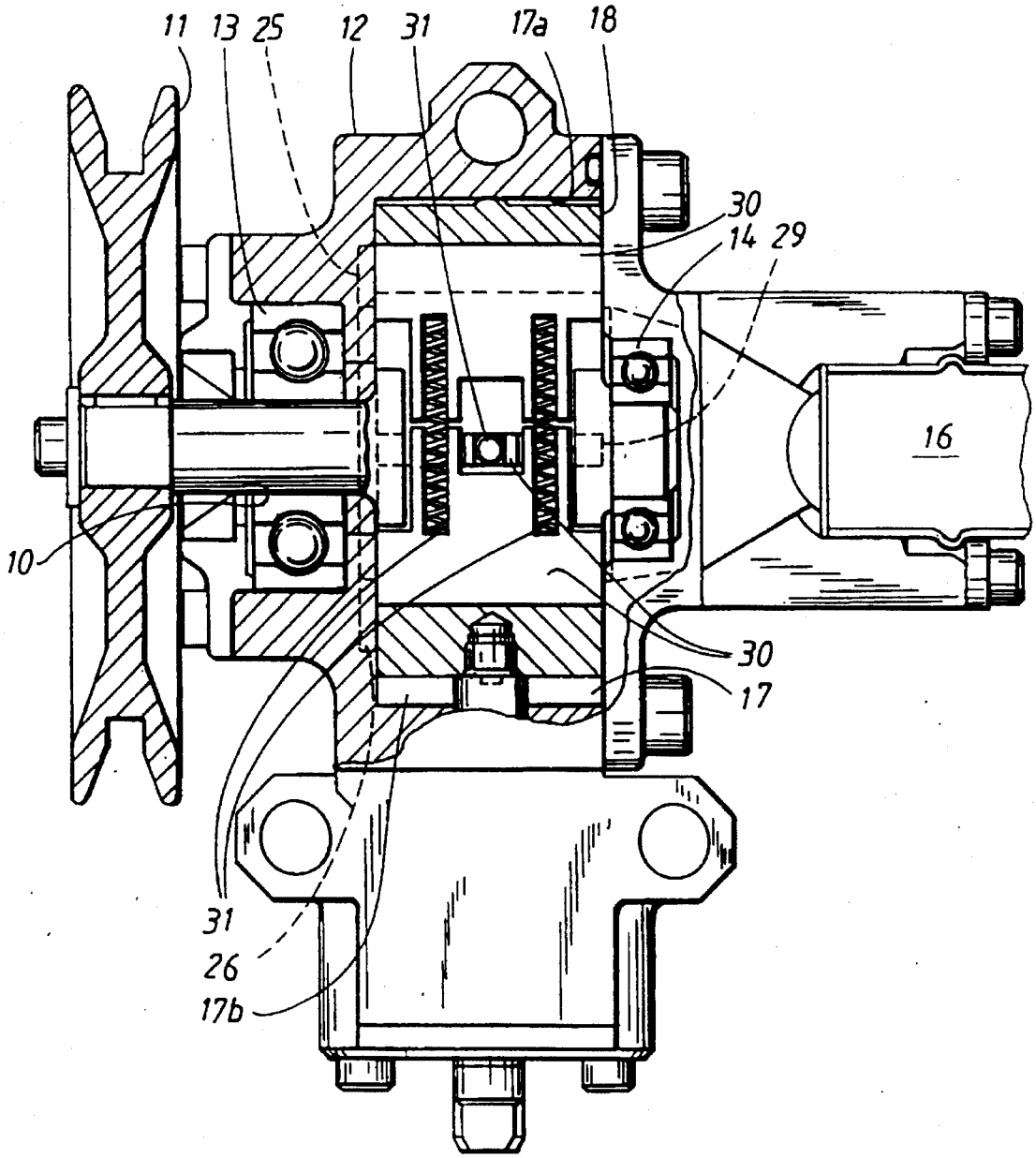
FIG. 1 shows a longitudinal section through a pump according to the invention.

The oil pump shown in the figures is driven by a shaft 10 of a pulley 11, which is connected with a power take-off of a combustion engine via a V-belt (not shown). The shaft 10 is supported in position in a pump housing 12 by means of bearings 13, 14 and is operated at a speed which is proportional to the speed of the combustion engine. The capacity of the pump is so adapted that it is able to maintain the necessary oil pressure even when the engine is driven at its lowest speed.

The pump housing 12 is provided with end walls 35, 36 a suction port 15 and a pressure port 16 arranged parallel to this. An oblong chamber 17 contains a displaceable sliding block 18, said sliding block being connected with a control rod 19 which extends out through the wall of the pump housing on one of the short sides of the housing via a passage sealed with a sealing ring 20.

The control rod 19 extends into a chamber 21 coaxial with the longitudinal direction of the rod, said chamber containing a damping fluid. The rod 19 extends into the chamber 21 with a larger portion **19*a* forming a piston which runs in contact with the wall of the cylinder chamber 21 and is sealed by means of a sealing ring 22. The piston portion 19*a* is provided with a nozzle 23 which allows a limited flow of damping fluid from one side of the piston to the other when the piston moves in the chamber 21. A set of cup-springs 24 urges the control rod 19 and the sliding block 18 upwards in the figures so that the sliding block rests against the upper short side of the oblong chamber 17**.

The sliding block 18 is formed such that a small space **17*a* is left when the sliding block rests against the upper short side of the oblong chamber 17 in said rest position. This space 17*a* communicates via a channel 25 with the pressure port 16. A larger space 17*b* communicates with the suction port 15 via a channel 26**.

Figure 4:
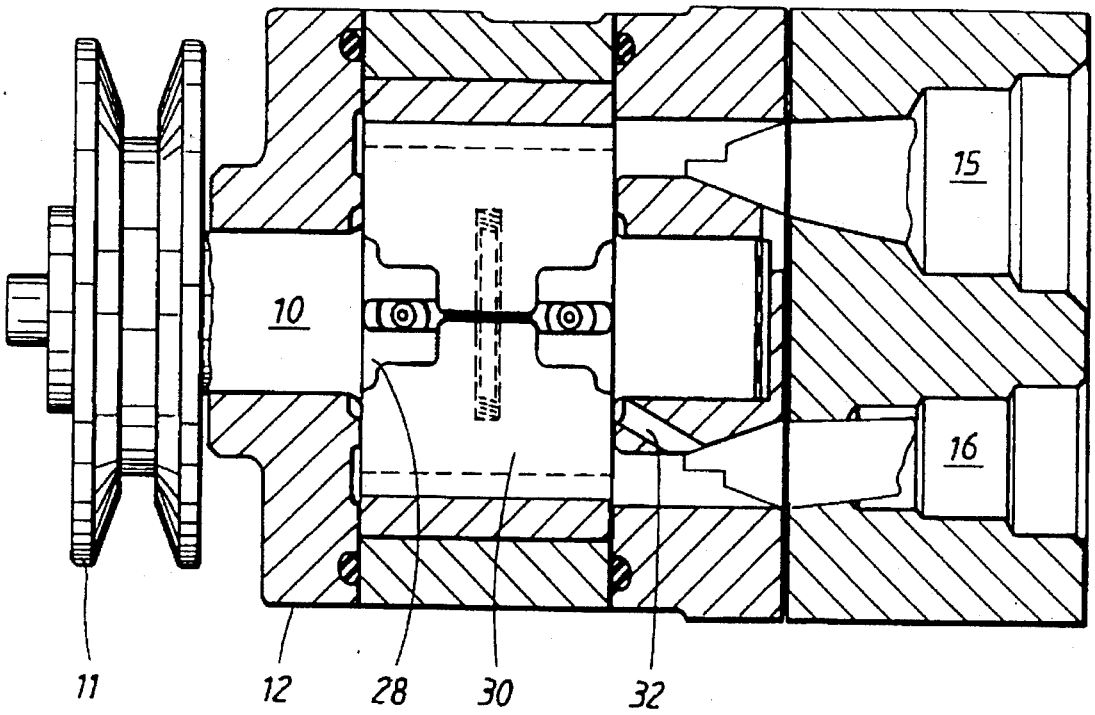
FIG. 4 is another longitudinal section through a second embodiment according to the invention.

The sliding block 18 is provided with a central cylindrical chamber 27 which surrounds a pump rotor 28 connected to a shaft 10. The rotor 28 is equipped with two through-going tracks 29 for four vanes 30 arranged in pairs. The vanes 30 are pressed into contact with the wall of the chamber by means of coil-springs 31 which are constrained between the vanes. Instead of, or in connection with, the coil-springs 31 and as shown in FIG. 4, the fluid pressure can be led in from the pressure side, e.g. from the pressure port 16, via a connection or channel 32 to a central portion of the pump rotor 28 radially behind the vanes 30 in order to press the vanes into contact with the wall of the chamber.

Figure 2:
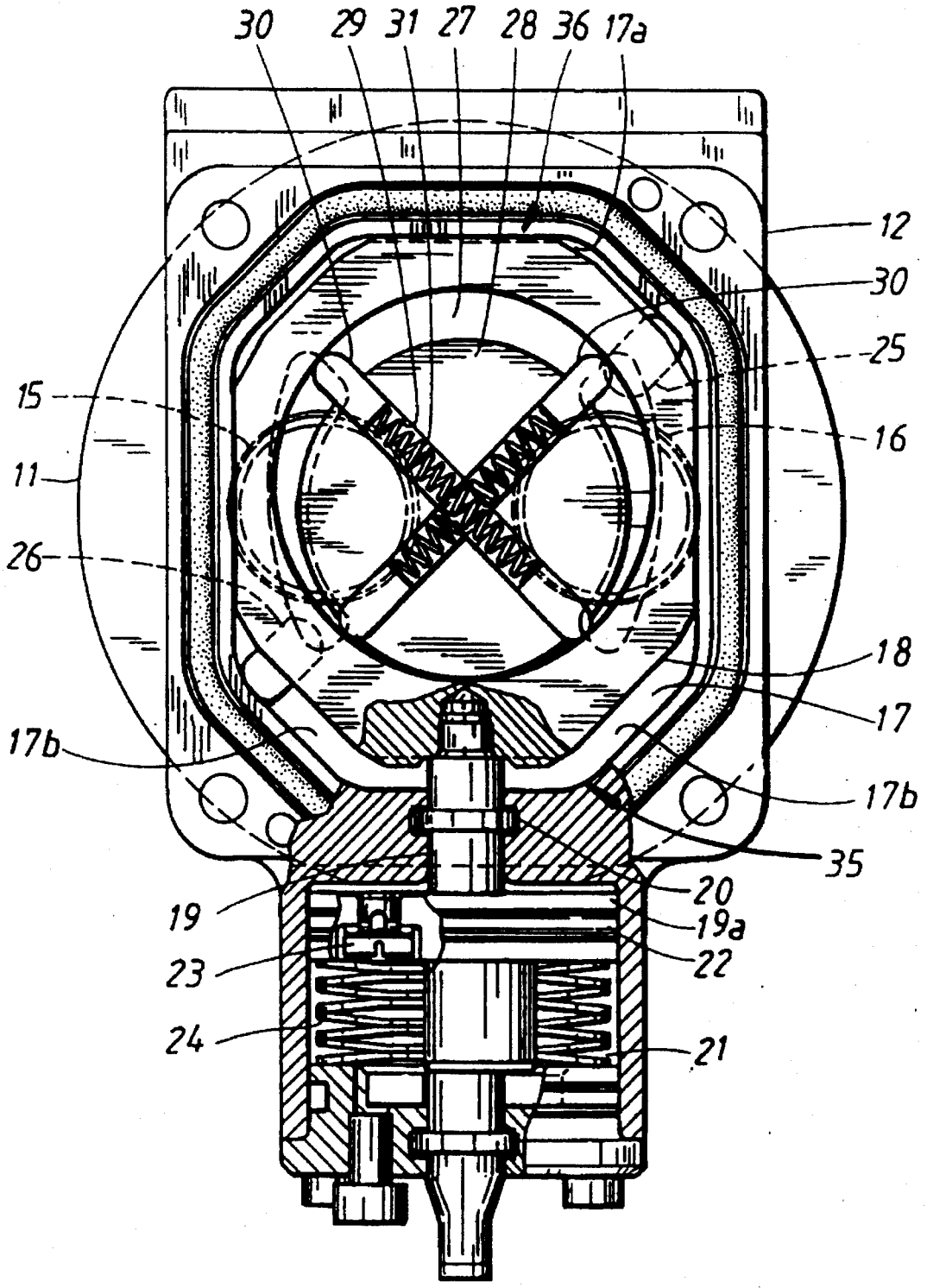
FIG. 2 is a cross-section through the pump shown in FIG. 1.

In the position depicted in FIG. 2, the sliding block 18 and chamber 27 is at an end position which provides a large eccentricity of the chamber with respect to the shaft. Since the chamber 27 is eccentric with respect to the rotor 28, the pump creates a flow from the suction port 15 to the pressure port 16 when the rotor rotates clockwise similar to a conventional vane pump.

Figure 3:
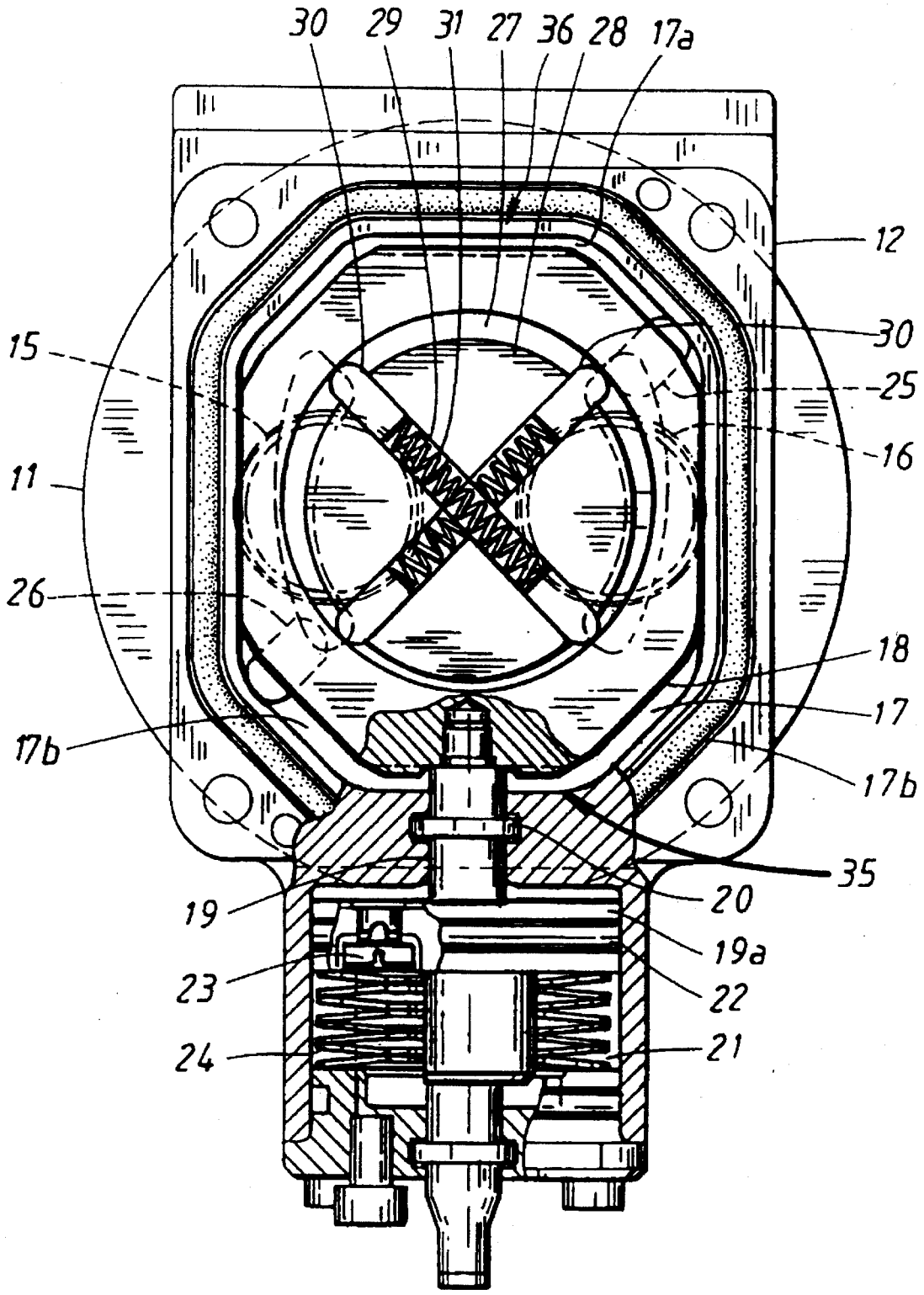
FIG. 3 shows the pump according to FIG. 2 with the sliding block displaced.

If however the pump is driven at such a large speed that a surplus pressure is generated, this surplus pressure will be transferred via the channel 25 from the pressure port 16 to the space 17*a*. The fluid pressure attempts to overcome the spring pressure in the cup-springs 24 so that these are compressed. The sliding block 18 is then displaced downwardly in the figures, as is clear from FIG. 3, which depicts the sliding block and chamber moved toward the end position opposite from that illustrated in FIG. 2. In this way the eccentricity of the chamber 27 from the center of the rotor is reduced. This means that the effective displacement of the pump is reduced and the rotor becomes easier to drive so that the energy requirement for driving the pump via the pulley 11 is reduced.

The damping chamber 21 has the task of damping the movements of the sliding block 18 so that this does not bang into the end walls.

The pump described above is only one embodiment of the invention. It is also possible to use the pump for gases. The pump can be operated at constant speed and the control rod 19 can be actively operated from the outside in order to vary the displacement for control of the pump's outlet flow and pressure.

The invention is not limited to the embodiment described above, but many variations are imaginable within the scope of the appended claims. For example, the control rod can be connected to other positioning means than those shown. Additionally the sliding block 18 can be controlled by means different than shown. The rotor 28 can be produced from an elastic material whereby the vanes can be in one piece with the rotor. Instead of using the channel 32, the fluid pressure can be led in from the pressure side to a central portion of the pump rotor 28 via an essentially radially running milling in the chamber wall.

We claim:

1. Pump comprising a pump housing having at least two end walls and a shaft driven rotor having at least two outwardly spring-biased vane elements, which lie in contact with a wall of a chamber surrounding said rotor and which, during rotation of said rotor, transport a gas and fluid medium from a suction port to a pressure port in said housing, said chamber being arranged in a sliding block which is displaceable inside said housing in such a way that said chamber is moveable between two end positions, of which one of said two end positions presents a comparatively small eccentricity with respect to said shaft of said rotor and of which a second of said two end positions presents a comparatively larger eccentricity with respect to said shaft, said sliding block being connected with a control rod for positioning said sliding block in said housing, wherein said control rod extends out through a first of said at least two end walls of said housing, said control rod being spring-biased in a direction towards a second of said at least two end walls of said housing, a space being arranged between said second of said at least two end walls and a side of said sliding block lying closest thereto, said space communicating with said pressure port, a space being arranged between said first of said at least two end walls of said housing and the opposite side of said sliding block communicating with said suction port, said vane elements of said rotor being supported, in pairs, in tracks which extend through said rotor wherein said tracks are common for each pair of vane elements, wherein a channel extends between said pressure port and a central portion of said rotor radially behind said vane elements in order to lead fluid pressure from said pressure port to said tracks behind said vane elements in order to press said vanes into contact with said wall of said chamber.

2. Pump according to claim 1, wherein said vane elements comprise spring members which are constrained between a pair of said vain elements.

3. Pump according to claim 1, wherein said control rod is connected with damping means.

4. Pump according to claim 3, wherein said damping means comprises a piston displaceable in a cylindrical chamber, said chamber containing a damping fluid and said piston being provided with a nozzle for throttling said clamping fluid flow from one side of said piston to the other.

* * * * *

UNITED STATES PATENT AND TRADEMARK OFFICE

CERTIFICATE OF CORRECTION

PATENT NO. : 5,618,165

DATED : April 8, 1997

INVENTOR(S) : Larsson et al.

It is certified that error appears in the above-identified patent and that said Letters Patent is hereby corrected as shown below:

[57] ABSTRACT, at the end of the paragraph, insert --.--.
Column 1, line 47, after "to", delete ",".
Column 2, line 20, after "36", insert --,--.
line 59, delete "is" and insert therefor --are--.
Column 4, line 30, "vain" should read --vane--.
line 37, delete "clamping" and insert therefor --damping--.

Signed and Sealed this

Twenty-fourth Day of June, 1997

Bruce Lehman

*Attest:*

BRUCE LEHMAN

*Attesting Officer*

*Commissioner of Patents and Trademarks*